United States Patent [19]

Blanchette

[11] 4,397,404

[45] Aug. 9, 1983

[54] PLASTIC CONTAINERS AND COVERS

[75] Inventor: Henry J. Blanchette, Leominster, Mass.

[73] Assignee: Plastican, Incorporated, Leominster, Mass.

[21] Appl. No.: 305,950

[22] Filed: Sep. 28, 1981

[51] Int. Cl.[3] ..... B65D 41/16; B65D 41/18

[52] U.S. Cl. ..... 220/306; 220/284; 220/307; 150/0.5; 206/508

[58] Field of Search ..... 220/306, 307, 284, 355, 220/356; 150/0.5; 206/508

[56] References Cited

U.S. PATENT DOCUMENTS

| | | | |
|---|---|---|---|
| 3,514,011 | 5/1970 | Madeira et al. | 220/284 |
| 4,210,258 | 7/1980 | Von Holdt | 220/306 |
| 4,308,970 | 1/1982 | Von Holdt | 220/306 |
| 4,334,631 | 6/1982 | Ballester | 220/306 |

FOREIGN PATENT DOCUMENTS

| | | |
|---|---|---|
| 992206 | 5/1965 | United Kingdom . |
| 1582416 | 1/1981 | United Kingdom . |

*Primary Examiner*—George T. Hall
*Attorney, Agent, or Firm*—Schiller & Pandiscio

[57] ABSTRACT

An improved plastic container and cover with three connections for sealing the cover to the container. The top end of the container has an annular flange on the inner side of its sidewall forming a slot. The cover has two walls extending downward from its outer lip. The walls mate with the slot and the inner portion of the flange so as to form a straight-sided capped container. Slots may be provided in the outer edge of the cover to allow the cover to be pried off the container.

6 Claims, 11 Drawing Figures

PLASTIC CONTAINERS AND COVERS

This invention relates to a capped plastic container with straight sides and more particularly to a plastic container with a stiff cover and three locking connections for the cover inside the rim of the container.

PRIOR ART

Containers with covers that make a seal with the top of the container so as to result in a capped container with straight sides are well known. Capped containers of this type are needed in some businesses, such as the paint industry, because they will roll in a straight line, as required by existing machinery used for applying labels to containers. Such containers are usually made of metal, especially in the paint industry.

Plastic containers with mating covers are exemplified in U.S. Pat. No. 4,210,258. Still other designs of plastic containers and covers are described in the references cited in the foregoing U.S. patent and also in British Pat. No. 1,582,416 filed on Apr. 12, 1978.

One problem common to some prior art plastic containers and covers is their failure to fit together so as to result in a capped container with straight sides. As described above, that problem is trouble-some in some businesses such as the paint industry. Another problem common to prior art plastic containers and covers is that the cover may be accidentally dislodged from the container. That problem is more likely with containers having at least one locking connection outside the upper rim of the container. A further problem is the inability of most prior art plastic containers and covers to withstand lateral force to the upper container rim when the container is dropped onto its side from any significant height. Another possible problem is difficulty in getting positive capping action with an automatic assembly line capping device when a rigid container and a resilient cover are used.

OBJECTS OF THE INVENTION

Accordingly, the primary object of this invention is to provide a new plastic container and cover that is designed so as to eliminate or substantially reduce the problems noted above.

Another object is to provide a plastic container and a mating plastic cover that simultaneously (a) provides a flush fit between the cover and the upper rim and sidewall of the container, thereby resulting in a capped container with straight sides, (b) provides for all locking connections to be on the inner side of the top rim and sidewall of the container, and (c) provides for easy removal of the cover using conventional methods.

A further object is to provide a capped plastic container of the type described that can withstand the impact forces produced when it is dropped onto its side from a significant height, whereby the cover remains sealed to the container without any spilling of the contents of the container.

SUMMARY OF THE INVENTION

The foregoing objects are achieved by a container/cover arrangement that in its preferred embodiment essentially comprises a plastic container with a cylindrical sidewall, a circular bottom wall, and a substantially stiff plastic cover with an outer lip. The container has an annular flange on the inner side of its sidewall adjacent its top rim. An annular upwardly-facing slot is formed by the flange and the upper end of the sidewall. The slot is designed to receive an annular wall extending downward from the outer lip of the cover. The annular wall, when positioned in the slot, is frictionally gripped by two of the surfaces defining the slot. In addition to these two locking connections, a third locking connection is provided by the innermost portion of the flange when it is positioned between the annular wall and a second concentric inner wall also extending downward from the outer lip of the cover, whereby the innermost upwardly-extending portion of the flange is also frictionally engaged by at least one of the surfaces between the two annular walls. All three locking connections are on the inner side of the container sidewall. The container sidewall extends below the bottom wall so as to form a bottom ridge that, when coupled with upwardly-extending projections on the top of the cover, prevents stacked containers from sliding laterally. The container also has two ears on diametrically opposed portions of its sidewall to retain a bail. Still other features of the invention are set forth in or rendered obvious by the following description which is to be considered together with the drawings.

THE DRAWINGS

In the several figures, like numerals are used to designate like parts except where otherwise indicated.

PREFERRED AND ALTERNATIVE EMBODIMENTS OF THE INVENTION

Figure 1:
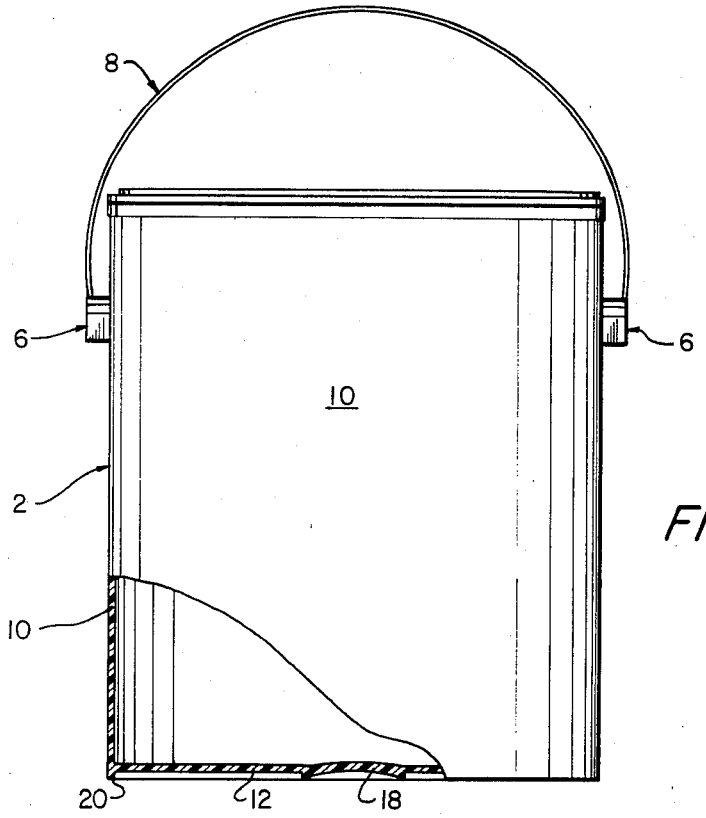
FIG. 1 is a side elevational view of a preferred form of a container and cover constructed in accordance with this invention, the drawing also showing a fragmentary sectional view of the bottom wall and sidewall of the container.

Turning first to FIG. 1, the illustrated apparatus comprises a container 2, a cover 4, two ears 6 integrally molded with the container, and a bail 8.

Figure 2:
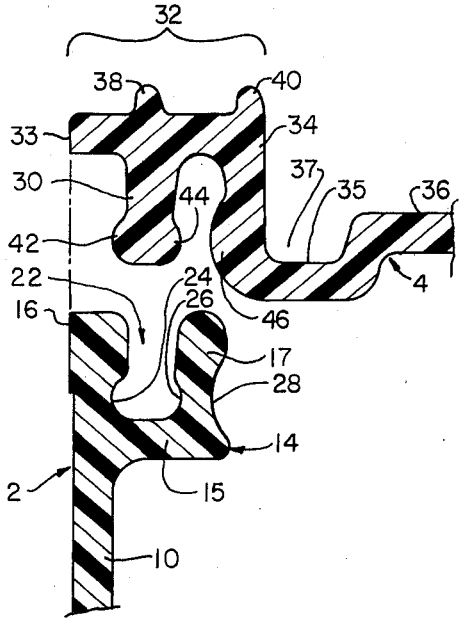
FIG. 2 is an enlarged fragmentary sectional view in elevation of the top portion of the container and cover of FIG. 1 with the cover a short distance above the container in position to be pushed straight downward and sealed to the container.
Figure 4:
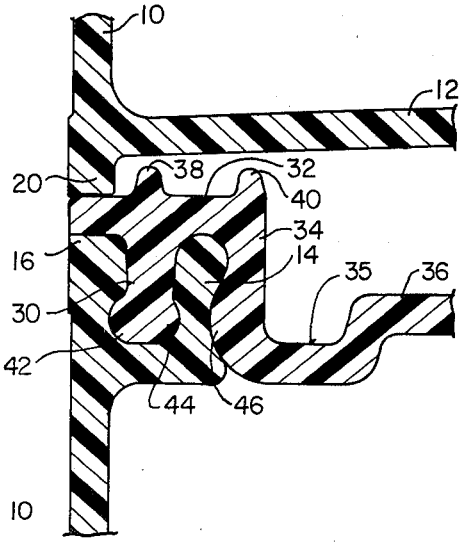
FIG. 4 is an enlarged fragmentary sectional view in elevation of the same container and cover with the cover sealed to the container, and with the bottom of an identical second container in position to be stacked on top of the first container.

As shown in FIGS. 1, 2, and 4, container 2 comprises a cylindrical sidewall 10, a circular bottom wall 12, and an annular flange 14 projecting inward from the upper end of sidewall 10. The upper end of sidewall 10 terminates in a top rim 16. Bottom wall 12 has a circular depression 18 curving upward at its center, and sidewall 10 extends downward below bottom wall 12 to form a bottom ridge 20. Flange 14 comprises two parts—an outer bottom portion 15 attached to sidewall 10 and extending radially inward where it is attached to a second inner portion 17 that extends upward in an axial direction. A slot 22 is formed by the inside surface of sidewall 10, the upper surface of outer portion 15, and the outside surface of inner portion 17. Slot 22 has a groove 24 in its outer bottom corner and a groove 26 in its inner bottom corner. Grooves 24 and 26 have the same radius of curvature. The inside surface of flange 14 has a third groove 28 with a radius of curvature greater than the radius of grooves 24 and 26.

Figure 5:
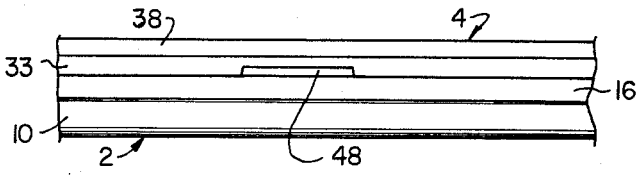
FIG. 5 is a fragmentary side elevational view of the top of the same container and cover with the cover sealed to the container and showing a removal slot in the cover.
Figure 6:
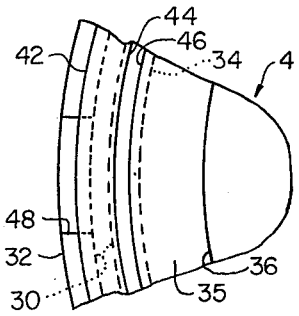
FIG. 6 is a fragmentary bottom view of the outer lip of the same cover showing the same removal slot of FIG. 5.

Turning now to FIGS. 1, 2, 5, and 6, cover 4 has an annular outer lip 32, terminating in an outer edge 33, an outside wall 30 extending downward from outer lip 32, and an inside wall 34 that is concentric with outside wall 30 and joins outer lip 32 with an annular portion 35 that is connected in turn to an inner portion 36 of cover 4. A depression 37 is formed by wall 34 and portions 34 and 36. Outer lip 32 has two ribs or ridges 38 and 40 projecting upward; outer ridge 38 is directly above outside wall 30 and inner ridge 40 is directly above inside wall 34. Outside wall 30 has two beads 42 and 44 projecting from its bottom end. Outer bead 42 projects outward and makes a snug fit in groove 24, and inner bead 44 projects inward and makes a snug fit in groove 26. A third bead 46 projects outward from inside wall 34 and makes a snug fit in groove 28. As shown in FIGS. 5 and 6, cover 4 has a removal slot 48 formed in its outer edge 33. Slot 48 is perpendicular to the center axis of container 2.

Turning again to FIG. 1, ears 6 are located at diametrically opposite positions and are provided with openings (not shown) to receive the opposite ends of bail 8. The ends of metal bail 8 are bent inwardly so as to form blocks which fit in the holes in ears 6 and pivotally secure the bail to the ears, whereby the bail can support the weight of the container 2 and its contents.

Figure 3:
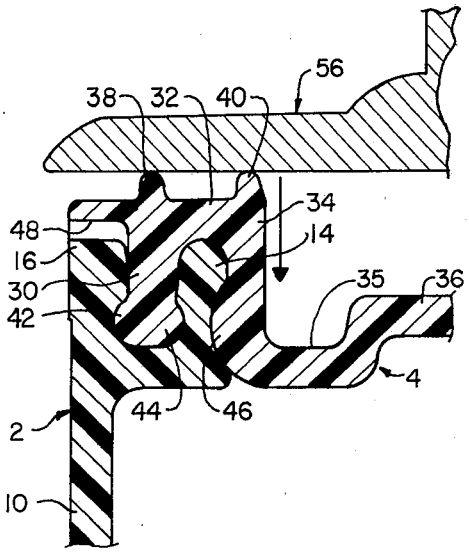
FIG. 3 is an enlarged fragmentary side sectional view of the same container and cover after the cover has been pushed down and sealed to the container by a capping device.

Turning now to FIGS. 2 and 3, cover 4 is shown in FIG. 2 before it is locked into place in container 2 and in FIG. 3 after it has been locked into place by a similar metal plate 56 which forms part of an automatic capping device (not shown). Normally, cover 4 would be pushed downward and locked into place on an assembly line by metal plate 56 of the automatic capping device. Ridges 38 and 40 are located directly above walls 30 and 34, respectively, so as to transmit the downward force of capping device member 56 to the walls 30 and 34, thereby to facilitate locking the cover to the containers by the snap-fit connections formed by beads 42, 44, and 46 and grooves 24, 26, and 28, respectively. Outer ridge 38 also serves to prevent stacked containers 2 from moving or sliding on the cover 4. As seen in FIG. 4, the bottom ridge 20 of a container 2 stacked on top of a second container 2 is restrained from moving laterally due to the close proximity of concentric ridge 38 just inside the bottom ridge 20.

Figure 7:
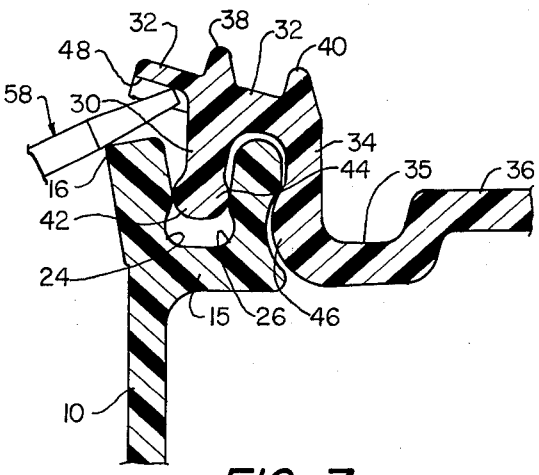
FIG. 7 is an enlarged fragmentary sectional view in elevation of the same container and cover showing the cover being pried off the container by the end of an opening tool inserted into the same removal slot in the cover.

Turning now to FIGS. 5–7, removal slot 48 allows a tool 58, such as a screwdriver, to be used to pry cover 4 off container 2. One end of tool 58 is inserted into slot 48 perpendicular to the center axis of container 2. Using the upper end surface of rim 16 of container 2 as a fulcrum, the opposite end of tool 58 is pushed downward to apply an upward leveraged force to the outer lip 32 of cover 4 and thereby disengage beads 42, 44, and 46 from grooves 24, 26, and 28, respectively. Cover 4 can have one or more removal slots 48 as reasonably desired.

Cover 4 is manufactured so as to be substantially stiff. Container 2 also is stiff but has sufficient resiliency for its rim and flange to be bendable for attachment and removal of the cover as shown in FIGS. 3 and 7. Therefore, rim 16 and flange 14 grip cover 4 when cover 4 is locked into place, and the stiffness of cover 4 provides for a more positive locking action during automatic capping on an assembly line than experienced in prior art containers and covers utilizing a resilient cover with a rigid or stiff container.

The invention has other advantages as well. The outer edge 33 of cover 4 lies flush with sidewall 10 when cover 4 is locked into place. This flush fit is similar to that achieved with other prior art containers and covers of different design and is important in that it meets the paint industry's requirement that containers and covers form straight sides to allow the capped containers to roll in a straight line, thereby allowing paper labels to be applied to the containers by currently existing labelling machinery in which capped containers lie and roll on their side during the labelling operation. However, this invention is an improvement over containers and covers of prior known design because the cover 4 is less likely to become dislodged from the container 2 by accidentally catching on other objects such as loading pallets or other containers. This advantage results from the location of flange 14 on the inner side of sidewall 10. This inward projection allows all locking connections to remain inside the rim 16, whereas prior art containers and covers normally have at least one locking connection outside the rim of the container, where it is more directly exposed to the disengaging force of an object accidentally catching on the edge of the cover. Also helping to prevent accidental separation of the cover and container are the three locking connections made by beads 42, 44 and 46 with grooves 24, 26 and 28. In contrast, most prior art containers and covers have a maximum of two locking connections. The three locking connections provided by beads 42, 44, and 46 and grooves 24, 26, and 28 respectively enable the capped container 2 to better withstand large lateral forces suddenly applied to its top rim 16, as when it is dropped onto its side, because at least one of the locking connections would tend to seal more tightly when-ever such a lateral force is applied. For example, when a capped container 2 filled with paint is dropped onto its side from a height of several feet, the side impacting on the ground or floor would have two locking connections tending to form a tighter seal—groove 24 would be forced toward bead 42, and groove 28 would be forced toward bead 46. The side of the container 2 opposite the ground or floor would have one locking connection tending to seal more tightly; at that side groove 26 and bead 44 would tend to more tightly engage one another. Still other advantages will be obvious to persons skilled in the art.

Figure 8:
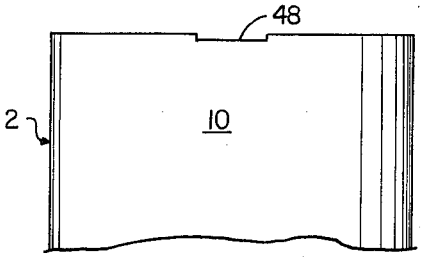
FIG. 8 is a fragmentary side elevational view of the top of a modified container with a removal slot in its top outer edge.

FIG. 8 shows a modification to the container 2 and cover 4 of FIG. 1 in that removal slot 48A is manufactured into the top rim 16 of container 2 rather than the outer edge 33 of cover 4.

Figure 9:
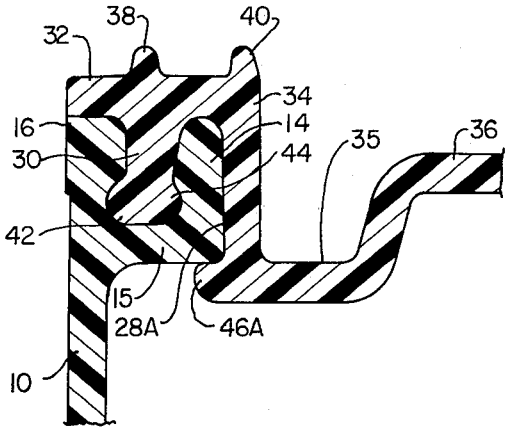
FIG. 9 is an enlarged fragmentary sectional view in elevation of the top portion of a modified container and cover with the cover sealed to the container.

FIG. 9 shows a container 2 and cover 4 similar to those in FIG. 1; however, the innermost locking connection has been modified by replacing bead 46 with a lip 46A; also groove 28 has been replaced by a straight inner surface 28A so that flange 14 lies flush against a straight outside surface of wall 34. Lip 46A forms the modified locking connection by wrapping around the inside bottom of the inner portion 17 of flange 14.

Figure 10:
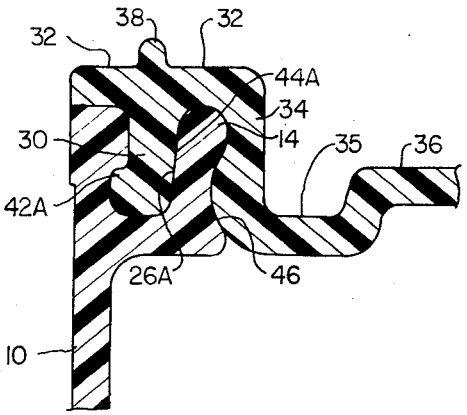
FIG. 10 is an enlarged fragmentary sectional view in elevation of the top of a modified container and cover with the cover sealed to the container.
Figure 11:
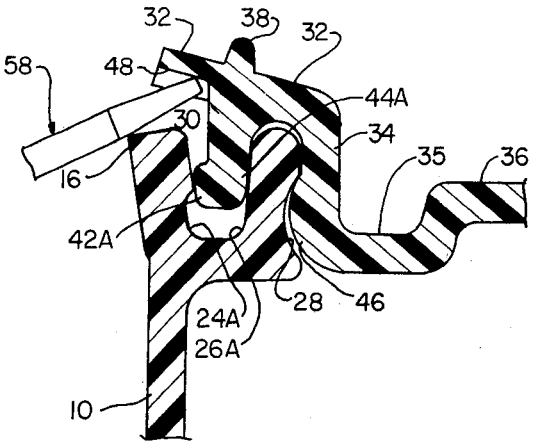
FIG. 11 is an enlarged fragmentary sectional view of the modified container and cover of FIG. 10 with the cover being pried off by the end of an opening tool inserted into a removal slot in the cover.

FIGS. 10 and 11 show a container and cover similar to those in FIG. 1 with the two outside locking connections modified. The outermost locking connection has been modified by replacing bead 42 and groove 24 with a foot 42A and a matching groove 24A. The middle locking connection has been done away with completely by replacing bead 44 and groove 26 with straight surfaces 44A and 26A, respectively, on the inside surface of wall 30 and the inside surface of slot 22. As shown in FIG. 11, the cover 4 has a removal slot 48 allowing it to be removed with an opening tool in the manner described for the container and cover in FIG. 1.

As noted above, a decided advantage of the invention is that it makes it possible to provide molded plastic containers with attached covers wherein (a) the containers have flat sides and the covers do not protrude beyond the outer periphery of the containers and (b) each cover is attached to a container by a plurality of sealing connections arranged so that if the container or cover is subjected to an impact which tends to loosen one or more of the sealing connections, at least one sealing connection will be unaffected or be improved by the impact. Another important advantage of the invention is that it allows substantially thinner wall sections to be used throughout the container and the cover than is permissible with prior designs. In this connection it is to be noted that in the embodiments shown in FIGS. 2, 9 and 10, various sections of the container and cover, e.g., section 10, 15, 16, 17, 30, 34, 35 and 36, may have thicknesses which vary from one another by relatively small amounts. Having relatively small cross-sectional thicknesses throughout the locking connections between the container and cover is advantageous in that the cycle time of the usual molding operation depends upon the maximum wall thickness of the part being molded. In general, the greater the wall thickness of the molded part, the longer the cycle time.

Another important advantage of the invention is that the sections 16, 30, 17 and 34 are so dimensioned that when the cover and container are locked together, those sections together form a substantially square section (see FIG. 3). This square cross-sectional configuration provides substantial rigidity which (a) allows a number of filled containers to be stacked one upon the other without any damaging deformation and (b) helps to preserve the integrity of the locking connection between the container and cover under various conditions.

Containers embodying the present invention may be made with conventional molding equipment using molds having collapsible cores according to techniques well known to persons skilled in the art.

It is to be noted that the invention is capable of a number of additional modifications. Thus, for example, grooves 24 and 26 may have different radii of curvature and different depths. In fact in the embodiment of FIG. 2, groove 24 preferably has a greater depth than groove 26. It also is to be appreciated that ribs 38 and 40 serve to strengthen the cover as well as to facilitate stacking, and these ribs may have a different cross-sectional shape. Also one of the ribs 38 and 40 may be omitted or one or more ribs may be added to the cover.

It is contemplated that the container and cover may be modified in still other ways obvious to persons skilled in the art without departing from the essence of the invention.

What is claimed is:

1. Container apparatus comprising in combination: a container comprising a side wall having a top end and a bottom end, a bottom wall closing off said bottom end, and a resilient circumferentially-extending flange; said top end terminating in a substantially flat upper edge; said flange having (1) a substantially annular outer flange portion attached to said top end of said sidewall a predetermined distance below said upper edge and (2) a substantially tubular inner flange portion attached to said outer flange portion and spaced inwardly from said side wall, so that an annular slot is formed by said flange and said side wall with said slot being closed at its bottom side and open at its top side and having first and second oppositely disposed locking grooves near its closed bottom side formed at least in part by recessed portions of said side wall and said inner flange portion; and a third groove on the inner side of said tubular inner flange portion, a circular cover comprising a center body portion surrounded by and integral with an annular outer lip portion that terminates in an outer edge, concentric inner and outer tubular wall portions formed integral with and extending down substantially at a right angle from said lip portion, said outer tubular wall portion also being concentric with and spaced inwardly of said outer edge; said outer tubular wall portion terminating in first and second opposed beads and said inner tubular wall portion having a third bead in confronting relation with said second bead, said outer tubular wall portion of said cover extending into said slot so that said first and second beads are locked in said first and second grooves and said inner flange portion extending between said inner and outer tubular wall portions so that said third bead is locked in said third groove, whereby said cover is locked to said container, and said center body portion of said cover being recessed below said annular lip portion and said annular lip portion substantially fully overlying and engaging said flat upper edge of said side wall, so that if a plurality of said containers with said covers locked thereto are stacked one upon the other in axial alignment, the compressive load presented by the weight of the stacked containers and their contents will be carried by the said side walls of said containers and not by said internal flange or said center body portion of said cover.

2. Apparatus according to claim 1 further including means on said cover adapted to be engaged by a capping device and to focus the downward force of such device onto at least one of said first and second tubular wall portions of said cover so as to facilitate locking of said cover to said container, said means comprising at least one ridge on the upper side of said cover located in line with one of sid first and second wall portions of said cover and projecting above the remainder of said cover.

3. Container apparatus comprising in combination:

a cylindrical container comprising a cylindrical side wall having a top end and a bottom end, a bottom wall closing off said bottom end, said upper end terminating in a substantially flat upper edge, an annular bottom ridge formed integral with said bottom end and surrounding and projecting below the outer margin of said bottom wall, and a resilient circumferentially-extending cover-retaining flange on the inner side of said side wall;

said flange having (1) an outer radially-extending annular flange portion attached to said upper end of said side wall a predetermined distance below said upper edge and (2) an inner tubular flange portion attached to said outer flange portion and spaced inwardly from said side wall so that an annular slot is formed by said flange and said side wall, with said slot having a closed bottom formed by said outer flange portion and an open top side formed by and between said side wall and said inner flange portion, and said slot having first and second oppositely disposed grooves near its bottom side formed at least in part by recessed portions of said side wall and said inner flange portion, and a third groove on the inner side of said inner flange portion, said three grooves being substantially in a common plane extending at a right angle to said side wall;

a circular cover having an annular outer lip portion with top and bottom sides terminating in an outer edge, at least one annular top ridge integral with and extending upward from the top side of said outer lip portion; a first outer tubular wall portion concentric with and spaced inwardly of said outer edge, a second inner tubular wall portion concentric with and spaced inwardly from said first tubular wall portion, said first and second tubular wall portions being integral with and extending downward at substantially a right angle from said outer lip portion, said first tubular wall portion having a bead on each side thereof and said second tubular wall portion having a bead on a side thereof confronting said first tubular wall portion, said first tubular wall portion of said cover extending into said slot so that the beads thereof reside in said first and second grooves and said inner flange portion extending between said first and second tubular wall portions so that the bead on said second tubular wall portion resides in said third groove, said first tubular wall portion being frictionally engaged by said flange and side wall and said inner flange portion being frictionally engaged by said first and second tubular wall portions;

the outermost one of said at least one top ridge being spaced inwardly of said outer edge and having an outside diameter less than the diameter of said bottom ridge, so that when two or more of said containers are stacked vertically, one on top of another, the said bottom ridge of an upper container will coact with the said top ridge of the cover of the next lower container so as to prevent relative lateral movement of said containers; and said outer lip portion of said cover overlying said upper edge of said container side wall so that when two or more of said containers are stacked one upon the other, the weight of each supported container is carried by the walls of the containers which support it.

4. Apparatus according to claim 1, further comprising means for facilitating removal of said cover from said container.

5. Apparatus according to claim 4 wherein said means for facilitating removal of said cover from said container comprises a radially-extending slot formed in said outer edge of said cover so as to accommodate an opening tool, whereby an end of said tool may be inserted into said slot and manipulated to pry said cover from said container.

6. Apparatus according to claim 1, further comprising an annular ridge at the bottom end of said container, said annular ridge being disposed so that when two or more of said containers are stacked one on top of the other, the annular ridge at the bottom of one of said containers will coact with a ridge on the cover of the next lower container to prevent relative lateral movement of said containers.

* * * * *

UNITED STATES PATENT AND TRADEMARK OFFICE

CERTIFICATE OF CORRECTION

PATENT NO. : 4397404

DATED : August 9, 1983

INVENTOR(S) : Henry J. Blanchette

It is certified that error appears in the above-identified patent and that said Letters Patent is hereby corrected as shown below:

Claim 2, column 7, line 5, the word "sid" should be -- said --.

Signed and Sealed this

*Twenty-fifth* Day of *October 1983*

[SEAL]

*Attest:*

GERALD J. MOSSINGHOFF

*Attesting Officer*

*Commissioner of Patents and Trademarks*